US007030769B2

(12) United States Patent
Miller

(10) Patent No.: US 7,030,769 B2
(45) Date of Patent: Apr. 18, 2006

(54) MONITOR PROVIDING CAUSE OF TRIP INDICATION AND CIRCUIT BREAKER INCORPORATING THE SAME

(75) Inventor: Theodore J. Miller, Oakdale, PA (US)

(73) Assignee: Eaton Corporation, Cleveland, OH (US)

( * ) Notice: Subject to any disclaimer, the term of this patent is extended or adjusted under 35 U.S.C. 154(b) by 96 days.

(21) Appl. No.: 10/712,946

(22) Filed: Nov. 13, 2003

(65) Prior Publication Data

US 2005/0103613 A1 May 19, 2005

(51) Int. Cl.
*G08B 21/00* (2006.01)

(52) U.S. Cl. ..... 340/635; 340/638; 340/649; 340/650; 361/17

(58) Field of Classification Search ..... 340/635, 340/638, 654, 656, 650, 649, 652, 664; 361/23, 361/93.8, 17, 18, 35
See application file for complete search history.

(56) References Cited

U.S. PATENT DOCUMENTS 4,642,733 A 2/1987 Schacht
5,038,246 A * 8/1991 Durivage, III ..... 361/93.2
5,220,479 A * 6/1993 Fraisse ..... 361/97
5,351,038 A * 9/1994 Goldberg ..... 340/644
5,546,266 A 8/1996 Mackenzie et al.
5,847,913 A * 12/1998 Turner et al. ..... 361/93.1
5,875,087 A * 2/1999 Spencer et al. ..... 361/87
5,926,355 A 7/1999 Matsko et al.
6,018,451 A * 1/2000 Lyke et al. ..... 361/93.2
6,122,157 A 9/2000 Gerlach
6,212,049 B1 4/2001 Spencer et al.
6,222,714 B1 * 4/2001 Hoffman ..... 361/93.2
6,239,677 B1 * 5/2001 Ramakrishnan et al. ..... 335/35
6,552,884 B1 * 4/2003 Kim et al. ..... 361/42
2003/0202304 A1 * 10/2003 Canova et al. ..... 361/93.1

FOREIGN PATENT DOCUMENTS

JP 05300617 A * 11/1993

* cited by examiner

*Primary Examiner*—Daniel Wu
*Assistant Examiner*—Travis R. Hunnings
(74) *Attorney, Agent, or Firm*—Martin J. Moran

(57) ABSTRACT

A circuit breaker with a thermal/magnetic trip device incorporates a monitor that senses the temperature of the bimetal and the amplitude of the load current to distinguish between a thermal and a magnetic trip. If the temperature of the bimetal is above a selected value when the circuit breaker trips, a "THERMAL" trip light emitting diode (LED) is energized, while a high load current at the time of a trip lights a "MAG" trip LED. The monitor also energizes an "ARC" LED in response to an arc fault signal from an AFCI at the time of trip, or a "GRD" LED in response to a ground fault trip. If a trip sensor, which monitors load voltage does not detect opening of the circuit breaker contacts when an arc fault or ground fault signal is generated, the corresponding LED is flashed to indicate the failure to trip. The monitor also has a "SURGE" LED to indicate a voltage surge in the protected distribution system as detected by a surge detector built into the circuit breaker. The trip and surge indications can be communicated to a remote location.

13 Claims, 3 Drawing Sheets

MONITOR PROVIDING CAUSE OF TRIP INDICATION AND CIRCUIT BREAKER INCORPORATING THE SAME

BACKGROUND OF THE INVENTION

1. Field of the Invention

The invention relates to a circuit breaker that incorporates a monitor providing an indication of line conditions such as surges and the cause of a trip such as a thermal trip, magnetic trip, arc fault trip or ground fault trip.

2. Background Information

A type of circuit breaker commonly used in residential and light commercial applications typically has a thermal/magnetic trip unit. This well known trip unit includes a bimetal that deflects in response to a persistent overload condition to actuate an operating mechanism that opens the separable contacts of the circuit breaker. A magnetic armature is attracted by the larger overcurrent caused by, for instance, a short circuit to also actuate the operating mechanism. There is no indication; however, as to which condition caused the circuit breaker to trip.

It is now common to incorporate electronic trip circuits in these breakers with thermal/magnetic trip units to provide protection against arc faults and ground faults. U.S. Pat. No. 5,546,266 discloses a circuit breaker of this type with light emitting diodes to provide a visual indication that a trip was caused by an arc fault or ground fault, as appropriate. However, it is not possible to identify a trip as caused by an overload or an overcurrent.

Some larger circuit breakers that utilize electronic circuits, now typically implemented by a microprocessor, to provide overload and overcurrent protection similar to that provided by the thermal/magnetic trip unit, have light emitting diodes distinguishing these two types of trips. For instance, U.S. Pat. No. 5,926,355 discloses such a circuit breaker that also has light emitting diodes to identify ground faults and short delay trips in addition to the thermal or long delay trip and an instantaneous or magnetic trip.

SUMMARY OF THE INVENTION

One aspect of the present invention is directed to a circuit breaker with a thermal/magnetic trip unit that incorporates a monitor providing an indication of the cause of a trip. That is, whether a persistent overload caused a thermal trip, or whether the breaker tripped in response to an instantaneous magnetic trip caused by an overcurrent. As another aspect of the invention, a surge detector is incorporated into the circuit breaker and the monitor includes an indicator to indicate the surge condition. The type of trip and surge indications can be presented at the circuit breaker, such as by light emitting diodes, or can be communicated to a remote location.

More particularly, the invention is directed to a circuit breaker for providing protection in an electric power distribution system wherein the circuit breaker comprises: separable contacts; an operating mechanism opening the separable contacts when actuated; and a trip unit comprising a thermal/magnetic trip device producing a thermal trip by actuating the operating mechanism in response to persistent overload conditions and producing a magnetic trip by actuating the operating mechanism in response to overcurrent conditions. The circuit breaker further comprises a monitor providing a thermal trip indication when the separable contacts are opened by the thermal trip and providing a magnetic trip indication when the separable contacts are opened by the magnetic trip. The thermal/magnetic trip device can comprise a bimetal heated by current passing through the separable contacts. The monitor can comprise a trip sensor sensing opening of the separable contacts, a temperature sensor sensing temperature of the bimetal, a processor generating a thermal trip signal in response to a sensed temperature above a selected value when the separable contacts open, and output means generating the thermal trip indication in response to the thermal trip signal. The monitor can further comprise a current sensor sensing current through the separable contacts and the processor can generate a magnetic trip signal in response to a sensed current signal above a selected value when the separable contacts open. In this instance, the output means generates the magnetic trip indication in response to the magnetic trip signal. The output means can comprise, for example, a thermal trip light emitting diode generating the thermal trip indication and a magnetic trip light emitting diode generating the magnetic trip indication. The output means can also comprise communication means for communicating the thermal trip indication and the magnetic trip indication remotely.

The trip unit can further comprise electronic trip circuitry generating an electronic trip signal indicating at least one of an arc fault and a ground fault, and a trip actuator responsive to the electronic trip signal to actuate the operating mechanism. In this case, the monitor provides at least one of an arc fault trip indication and a ground fault trip indication in response to the electronic trip signal. Where the electronic circuitry includes both an arc fault trip circuit and a ground fault trip circuit, the monitor provides indications of these two types of trips. The monitor can further comprise a surge detector detecting surges in the voltage in the electric power distribution system and can provide an indication of the surge. The monitor can include an output means that can provide a failure to trip indication in response to an arc fault or ground fault signal in the absence of a tripped indication from the trip sensor. This failure to trip indication can be a flashing of the associated light emitting diode.

In accordance with another aspect of the invention, a circuit breaker comprises: a housing; a trip device within the housing responsive to selected current characteristics for interrupting current in the electric power distribution system; and a monitor. The monitor comprises a surge detector within the housing generating a surge signal in response to detection of a voltage surge in the electric power distribution system, and an output generator generating a signal indicating the voltage surge in response to the surge signal. When the trip device comprises an electronic trip circuit and a power supply energized by the electric power distribution system supplies power to the electronic trip circuit, the surge detector can detect a surge in the voltage at the power supply.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
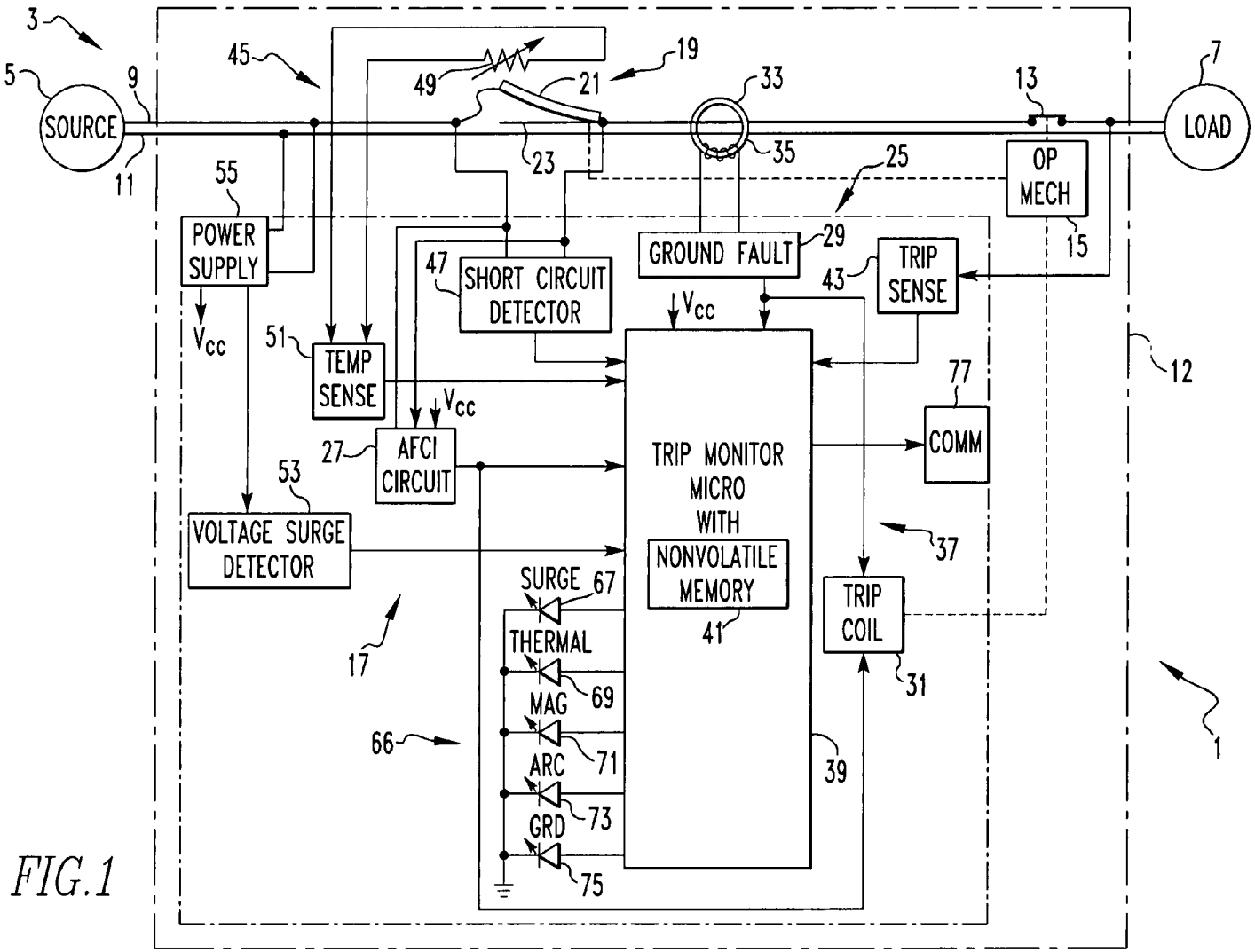
FIG. 1 is a schematic diagram of a circuit breaker incorporating the invention.

FIG. 1 illustrates a circuit breaker 1 in accordance with the invention that provides protection for an electric power distribution system 3 in which a source provides electric power to a load 7 over a line conductor 9 and neutral conductor 11. The circuit breaker 1 includes within a housing 12 a set of separable contacts 13 in the line conductor 9. The separable contacts are opened and closed by an operating mechanism 15. The operating mechanism 15 can be actuated manually by a handle (not shown) and automatically by a trip unit 17. The trip unit includes a conventional thermal/magnetic trip device 19. As is well known, such a device includes a bimetal 21 that is deflected in response to persistent overload conditions to actuate the operating mechanism 15. The thermal/magnetic trip device 19 also includes a magnetic armature 23 that is attracted by the magnetic field generated by an overcurrent, such as a short circuit, to actuate the operating mechanism 15 and open the separable contacts 13.

The trip unit 17 also includes electronic circuitry 25 that can include one or both of an arc fault current interrupter (AFCI) circuit 27 and a ground fault circuit 29. Circuits for detecting arc faults are well known. Typically, they monitor the load current for characteristics indicative of an arc fault. The AFCI circuit 27 senses the voltage drop across the known resistance of the bimetal 21 as a measure of the load current. Upon detection of an arc fault, the AFCI circuit 27 generates an arc fault signal that energizes a trip actuator in the form of a trip coil 31 to actuate the operating mechanism 15 and open the separable contacts 13.

Ground fault circuits 29 are well known. The exemplary ground fault detector 29 utilizes the sensing coil 33 through which the line and neutral conductors 9 and 11 are passed to form the primary. In the absence of a ground fault, the equal and opposite currents in the line and neutral conductors 9 and 11 cancel so that no output signal is generated on the secondary winding 35. A ground fault results in an imbalance in the currents through the line and neutral conductors 9 and 11 that is detected by the ground fault detector 29, which in turn generates a ground fault signal that also energizes the trip coil 31 to actuate the operating mechanism 15 and open the separable contacts 13.

The circuit breaker 1 incorporates a monitor 37 that has at its heart a processor in the form of a trip monitor microcontroller 39 having a nonvolatile memory 41. The monitor has several sensors including: a trip sensor 43, a temperature sensor 45, and a short circuit or overcurrent detector or sensor 47. The trip sensor 43 monitors the load voltage and generates a trip signal when the load voltage drops to zero following opening of the separable contacts 13. The temperature sensor 45 monitors the temperature of the bimetal 21. This is implemented in the exemplary sensor by a resistance temperature device (RTD) 49 placed adjacent to the bimetal 21, and a temperature sense circuit 51 that provides a signal representative of the bimetal temperature to the microcontroller 39. Various other types of temperature sensors could be used also. The short circuit detector 47 monitors the load current by also measuring the voltage drop across the known resistance of the bimetal 21 to provide a measure of load current to the microcontroller 39.

Figure 2:
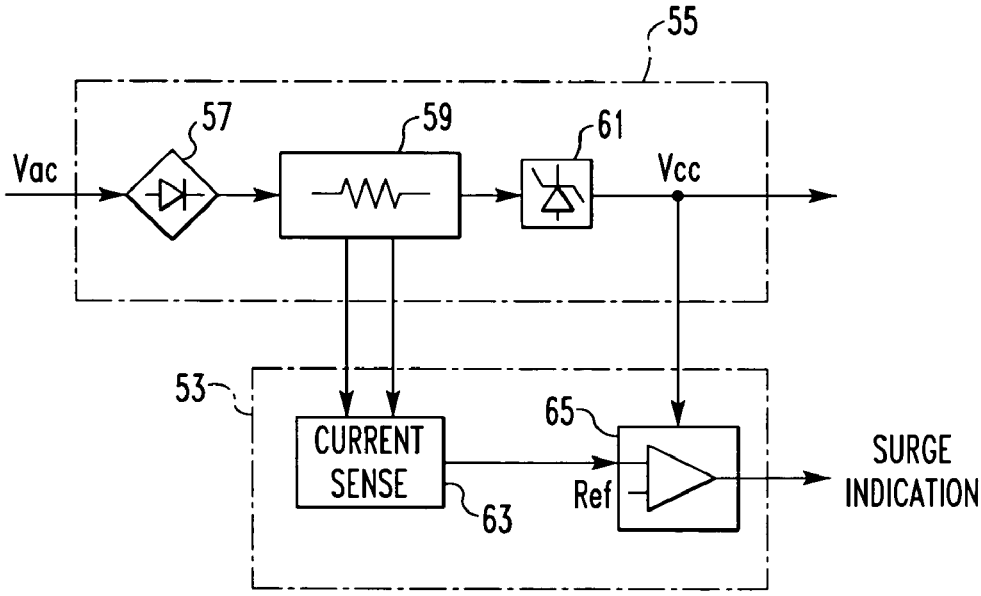
FIG. 2 is a schematic diagram of the power supply and surge detector which form part of the circuit breaker of FIG. 1.

The monitor 37 further includes a voltage surge detector 53 to provide a voltage surge signal to the microcontroller 39 when the power distribution system voltage exceeds a selected limit. The exemplary voltage surge detector 53 receives input from the power supply 55, which provides a supply voltage $V_{cc}$ for the electronic circuits of the circuit breaker. As shown in FIG. 2, the ac line voltage Vac of the power distribution system 3 is converted to dc by a rectifier 57, passed through a resistance 59 and applied to a voltage regulation circuit 61 to produce the dc supply voltage Vcc for powering the electronic circuits of the circuit breaker. The voltage drop across the resistor 59 is sensed by the current sensor 63 in the voltage surge detector 53 to produce a dc signal which is compared to a reference signal, Ref, in surge detection circuit 65. Returning to FIG. 1, the surge indication from the voltage surge detector 53 is applied to the microcontroller 39.

The microcontroller 39 processes any arc fault signal received from the AFCI circuit 27, any ground fault signal generated by the ground fault detector 29, and the signals generated by the trip sensor 43, the bimetal temperature sensor 45, the short circuit detector 47, and the voltage surge detector 53 and provides appropriate surge or trip indication through output devices 66, such as for example, light emitting diodes (LEDs). If a voltage surge is reported by the surge detector 53, the microcontroller 39 generates an indication of the surge. In the exemplary monitor 37, the surge indication is generated by a "surge" LED 67. If the microcontroller 39 is receiving a high bimetal temperature signal from the temperature sensor 45 when the trip sensor 43 indicates that the separable contacts 13 have opened, a thermal trip indication is generated such as by illumination of the "thermal" LED 69. Similarly, an indication of a magnetic trip is generated by lighting of a "mag" LED 71 if the current detected by the short circuit detector 47 exceeds a selected limit when the trip sensor 43 detects opening of the separable contacts 13. In like manner, an arc fault indication and a ground fault indication provided, respectively, in the exemplary monitor by the "arc" LED 73 and the "grd" LED 75 are generated if the microcontroller 39 receives an arc fault signal from the AFCI circuit 27 or ground fault signal from the ground fault detector 29 when the tripped sensor 43 senses opening of the separable contacts 13. In addition, or alternatively, the microcontroller 39 can provide the indications of a surge or the type of trip at a remote location through a communications module 77, which also serves as an output device 66. The microcontroller can store these surge and trip indications in the nonvolatile memory 41. It should be noted that the microcontroller 39 is not utilized in generating any of the trips. The thermal/magnetic trip device 19 responds to the persistent overloads and overcurrents in the same manner as in conventional circuit breakers. Similarly, the AFCI circuit 27 and ground fault circuit 29 energize the trip coil 31, whether or not the microcontroller 39 is operational.

Figure 3:
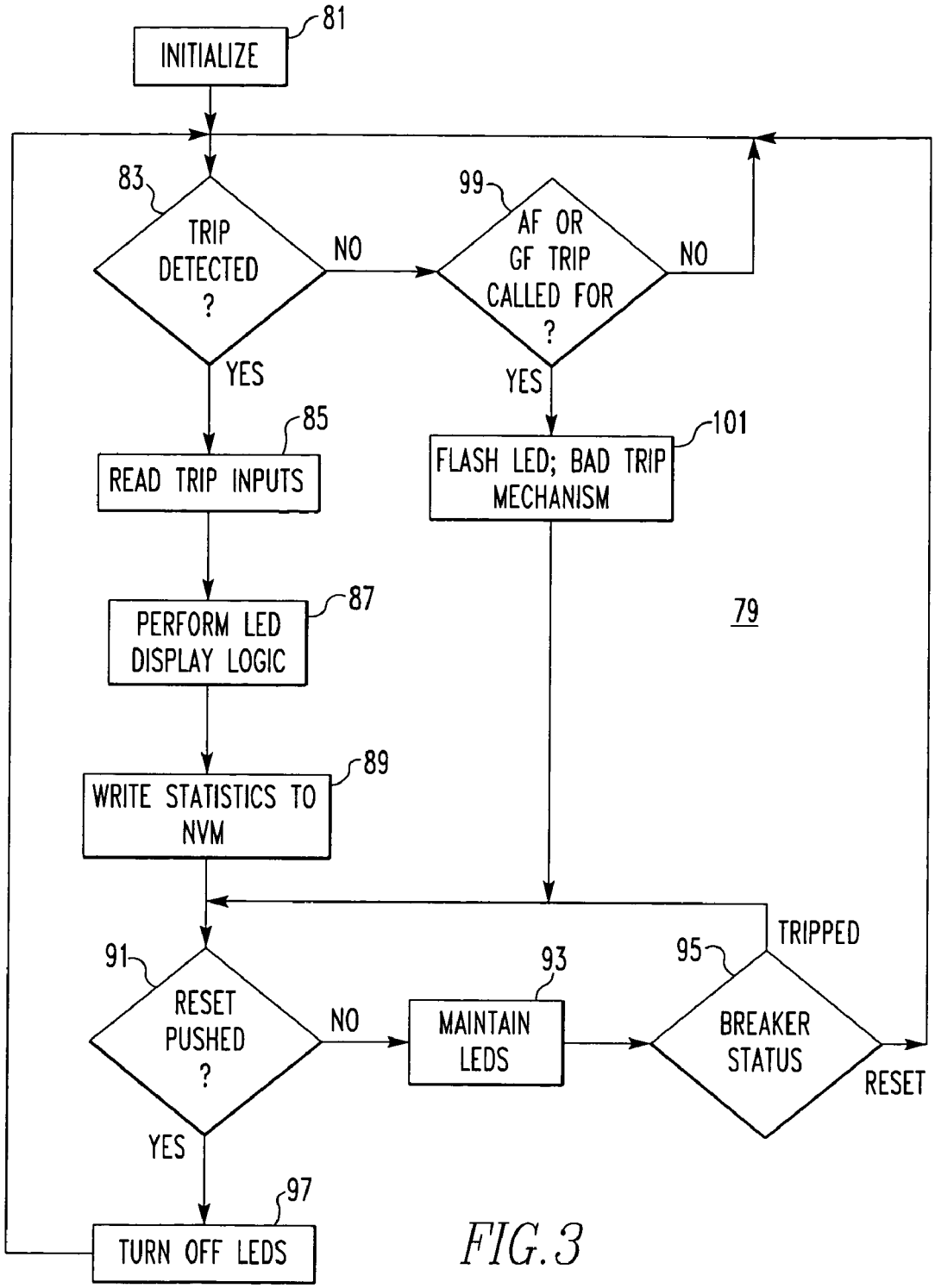
FIG. 3 is a flow chart of the operation of the trip monitor which forms part of the circuit breaker of FIG. 1.

FIG. 3 illustrates a flow chart 79 for the microcontroller 39. After initializing at 81 following start-up a check is made at 83 for a trip of the circuit breaker, which begins with a signal from the trip sensor 43 that the separable contacts 13 have opened. If the breaker has opened, at 85, signals from the temperature sensor 45, the short circuit detector 47, the arc fault circuit 27 and the ground fault circuit 29 are evaluated for a trip condition as described above and the appropriate LED is illuminated at 87. These events are then written to the nonvolatile memory at 89. If no reset has been initiated as determined at 91 the appropriate LED remains energized at 93. If the breaker remains tripped as determined at 95, a loop is entered until a reset is initiated at 91, whereupon the LEDs are turned off at 97 and the program returns to trip detection. On the other hand, if the circuit breaker is reset at 95, the program also returns to trip detection, but the appropriate LED remain energized until reset. If no trip is detected at 83, but either an arc fault or ground fault signal has been generated as determined a 99, the appropriate LED is flashed at 101 to indicate a bad trip mechanism. This could occur, for instance, if the trip coil 31 or the operating mechanism 15 failed, or if the separable contacts 13 became welded shut.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker for providing protection in an electric power distribution system, the circuit breaker comprising:

separable contacts;

an operating mechanism opening the separable contacts when actuated;

a trip unit comprising a thermal/magnetic trip device producing a thermal trip by actuating the operating mechanism in response to persistent overload conditions and producing a magnetic trip by actuating the operating mechanism in response to overcurrent conditions; and a monitor providing a thermal trip indication when the separable contacts are opened by the thermal trip and providing a magnetic trip indication when the separable contacts are opened by the magnetic trip, wherein said trip unit produces said thermal trip and said magnetic trip independent of said monitor, wherein the thermal/magnetic trip device comprises a bimetal heated by current passing through the separable contacts and the monitor comprises a trip sensor sensing opening of the separable contacts, a temperature sensor sensing temperature of the bimetal, a processor generating a thermal trip signal in response to a sensed temperature above a selected value when the separable contacts open, and output means generating the thermal trip indication in response to the thermal trip signal.

2. The circuit breaker of claim 1, wherein the monitor further comprises an overcurrent sensor sensing current through the separable contacts and the processor generates a magnetic trip signal in response to a sensed current signal above a selected value when the separable contacts open, and the output means generates the magnetic trip indication in response to the magnetic trip signal.

3. The circuit breaker of claim 2, wherein the output means comprises a thermal trip light emitting diode generating the thermal trip indication and a magnetic trip light emitting diode generating the magnetic trip indication.

4. The circuit breaker of claim 2, wherein the output means comprises communication means for communicating the thermal trip indication and the magnetic trip indication remotely.

5. The circuit breaker of claim 1, wherein the trip unit further comprises electronic trip circuitry generating an electronic trip signal indicating at least one of an arc fault and a ground fault in the electric power distribution system and a trip actuator responsive to the electronic trip signal to actuate the operating mechanism, and wherein the monitor provides at least one of an arc fault trip indication and a ground fault trip indication in response to the electronic trip signal.

6. The circuit breaker of claim 5, wherein the electronic circuitry includes both an arc fault trip circuit and a ground fault trip circuit and the monitor provides both an arc fault trip indication and a ground fault trip indication.

7. The circuit breaker of claim 6, wherein the monitor comprises a surge detector detecting a surge in voltage in the electric power distribution system and provides an indication of the surge.

8. A circuit breaker for providing protection in an electric power distribution system, the circuit breaker comprising:

separable contacts;

an operating mechanism opening the separable contacts when actuated;

a trip unit comprising a thermal/magnetic trip device producing a thermal trip by actuating the operating mechanism in response to persistent overload conditions and producing a magnetic trip by actuating the operating mechanism in response to overcurrent conditions; and a monitor providing a thermal trip indication when the separable contacts are opened by the thermal trip and providing a magnetic trip indication when the separable contacts are opened by the magnetic trip, wherein said trip unit produces said thermal trip and said magnetic trip independent of said monitor, wherein the trip unit further comprises electronic trip circuitry generating an electronic trip signal indicating at least one of an arc fault and a ground fault in the electric power distribution system and a trip actuator responsive to the electronic trip signal to actuate the operating mechanism, and wherein the monitor provides at least one of an arc fault trip indication and a ground fault trip indication in response to the electronic trip signal, wherein the electronic circuitry includes both an arc fault trip circuit and a ground fault trip circuit and the monitor provides both an arc fault trip indication and a ground fault trip indication, wherein the monitor comprises a trip sensor sensing opening of the separable contacts, a temperature sensor sensing the temperature of the thermal magnetic trip device, an overcurrent sensor sensing current above a selected value through the separable contacts, a processor generating a thermal trip signal in response to the temperature secured by the temperature sensor above a selected value when the trip sensor senses opening of the separable contacts, generating a magnetic trip indication with the current of the overcurrent sensor above a selected value when the trip sensor senses opening of the separable contacts, generates an arc fault trip signal in response to an arc fault signal from the arc fault circuit when the trip sensor senses opening of the separable contacts, generates a ground fault trip signal in response to a ground fault signal from the ground fault circuit when the trip sensor senses opening of the separable contacts, and output means generating the thermal trip indication in response to the thermal trip signal, the magnetic trip indication in response to the magnetic trip signal, an arc fault trip indication in response to the arc fault trip signal, and a ground fault trip indication in response to the ground fault trip signal.

9. The circuit breaker of claim 8, wherein the output means comprises a thermal trip light-emitting diode provid ing the thermal trip indication, a magnetic trip light emitting diode providing the magnetic trip indication, an arc fault light emitting diode generating the arc fault trip indication, and a ground fault light emitting diode generating the ground fault trip indication.

10. The circuit breaker of claim 9, wherein the arc fault trip light emitting diode or the ground fault trip light emitting diode flashes in response to an arc fault trip signal or a ground fault trip signal, respectively, in the absence of a tripped indication from the trip sensor.

11. The circuit breaker of claim 8, wherein the output means comprises communication means for communicating the thermal trip signal, the magnetic trip signal, the arc fault trip signal, and the ground fault trip signal remotely.

12. The circuit breaker of claim 8, wherein the output means provides a failure to trip indication in response to an arc fault or ground fault signal in the absence of a tripped indication from the trip sensor.

13. The circuit breaker of claim 12, wherein the monitor comprises non-volatile memory retaining the thermal trip indication and the magnetic trip indication in the event of loss of power.

* * * * *